US011155086B2

(12) United States Patent
Choy et al.

(10) Patent No.: US 11,155,086 B2
(45) Date of Patent: Oct. 26, 2021

(54) FLUIDIC EJECTION DEVICES WITH ENCLOSED CROSS-CHANNELS

(71) Applicant: HEWLETT-PACKARD DEVELOPMENT COMPANY, L.P., Spring, TX (US)

(72) Inventors: Si-Iam Choy, Corvallis, OR (US); Michael W Cumbie, Corvallis, OR (US); Chien-Hua Chen, Corvallis, OR (US); Jeffrey R Pollard, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/630,020

(22) PCT Filed: Jul. 31, 2017

(86) PCT No.: PCT/US2017/044742
§ 371 (c)(1),
(2) Date: Jan. 10, 2020

(87) PCT Pub. No.: WO2019/027432
PCT Pub. Date: Feb. 7, 2019

(65) Prior Publication Data

US 2020/0164647 A1 May 28, 2020

(51) Int. Cl.
*B41J 2/14* (2006.01)
*B41J 2/16* (2006.01)

(52) U.S. Cl.
CPC ..... *B41J 2/14145* (2013.01); *B41J 2/14201* (2013.01); *B41J 2/1601* (2013.01);
(Continued)

(58) Field of Classification Search
CPC .... B41J 2/1637; B41J 2/14145; B41J 2/1433; B41J 2/1601; B41J 2002/14419;
(Continued)

(56) References Cited

U.S. PATENT DOCUMENTS 6,244,694 B1 6/2001 Weber
6,513,896 B1 2/2003 Kawamura
(Continued)

FOREIGN PATENT DOCUMENTS

CN 102470672 5/2012
CN 102971151 3/2013
(Continued)

OTHER PUBLICATIONS

Silicon Mems Printhead FAQ, Nov. 23, 2016 < https://www.linkedin.com/pulse/silicon-mems-printhead-faq-tim-phillips >.

*Primary Examiner* — Jannelle M Lebron
(74) *Attorney, Agent, or Firm* — Fabian VanCott

(57) ABSTRACT

In one example in accordance with the present disclosure, a fluidic ejection device is described. The device includes a fluidic ejection die embedded in a moldable material. The die includes an array of nozzles. Each nozzle includes an ejection chamber and an opening. A fluid actuator is disposed within the ejection chamber. The fluidic ejection die also includes an array of passages, formed in a substrate, to deliver fluid to and from the ejection chamber. The fluidic ejection die also includes an array of enclosed cross-channels. Each enclosed cross-channel of the array of enclosed cross-channels is fluidly connected to a respective plurality of passages of the array of passages. The device also includes the moldable material which includes supply slots to deliver fluid to and from the fluidic ejection die. A carrier substrate of the device supports the fluidic ejection die and moldable material.

20 Claims, 12 Drawing Sheets

(52) U.S. Cl.
CPC ..... *B41J 2/1607* (2013.01); *B41J 2/1626* (2013.01); *B41J 2002/14419* (2013.01)

(58) Field of Classification Search
CPC .. B41J 2/1607; B41J 2/14201; B41J 2202/19; B41J 2/175; B41J 2/14016; B41J 2002/14362; B41J 2/1626
See application file for complete search history.

(56) References Cited

U.S. PATENT DOCUMENTS

| | | | |
|---|---|---|---|
| 8,109,607 | B2 | 2/2012 | Chen et al. |
| 8,382,253 | B1 | 2/2013 | Rivas et al. |
| 8,438,730 | B2 | 5/2013 | Ciminelli |
| 8,449,086 | B2 | 5/2013 | Price et al. |
| 8,672,463 | B2 | 3/2014 | Essen et al. |
| 8,757,783 | B2 | 6/2014 | Govyadinov |
| 8,814,293 | B2 | 8/2014 | Struck et al. |
| 9,221,247 | B2 | 12/2015 | Cruz-Uribe et al. |
| 2005/0018016 | A1 | 1/2005 | Silverbrook |
| 2006/0131264 | A1 | 6/2006 | Kawamura et al. |
| 2010/0328409 | A1 | 12/2010 | Matsufuji et al. |
| 2011/0018940 | A1 | 1/2011 | McAvoy et al. |
| 2011/0205303 | A1 | 8/2011 | Pan et al. |
| 2014/0063132 | A1 | 3/2014 | Scheffelin et al. |
| 2014/0104348 | A1 | 4/2014 | Owaki et al. |
| 2016/0016404 | A1 | 1/2016 | Chen et al. |
| 2016/0288499 | A1 | 10/2016 | Sugahara et al. |
| 2017/0028722 | A1 | 2/2017 | Chien-Hua |
| 2017/0197417 | A1 | 7/2017 | Karita et al. |

FOREIGN PATENT DOCUMENTS

| | | |
|---|---|---|
| CN | 104066585 | 9/2014 |
| EP | 1566274 | 8/2005 |
| EP | 3099493 | 12/2016 |
| JP | 2008200902 | 9/2008 |
| JP | 2009226942 | 10/2009 |
| JP | 2011073435 | 4/2011 |
| JP | 2013532594 | 8/2013 |
| JP | 2014054844 | 3/2014 |
| JP | 2014522755 | 9/2014 |
| JP | 2014531349 | 11/2014 |
| JP | 2016511717 | 4/2016 |
| JP | 2016515952 | 6/2016 |
| JP | 2017513741 | 6/2017 |
| JP | 2017124614 | 7/2017 |
| JP | 2017124615 | 7/2017 |
| TW | 201304971 A1 | 2/2013 |
| WO | WO-2011146149 | 11/2011 |
| WO | WO-2014042625 | 3/2014 |
| WO | WO-2014133517 | 4/2014 |
| WO | WO-2014133517 | 9/2014 |
| WO | WO-2015041665 | 3/2015 |
| WO | WO-2016137490 | 9/2016 |
| WO | WO-2017065728 | 4/2017 |
| WO | WO-2017065730 | 4/2017 |
| WO | WO-2017074354 | 5/2017 |
| WO | WO-2017098962 | 6/2017 |

FLUIDIC EJECTION DEVICES WITH ENCLOSED CROSS-CHANNELS

BACKGROUND

A fluidic ejection die is a component of a fluid ejection system that includes a number of fluid ejecting nozzles. The fluidic die can also include other non-ejecting actuators such as micro-recirculation pumps. Through these nozzles and pumps, fluid, such as ink and fusing agent among others, is ejected or moved. For example, nozzles may include an ejection chamber that holds an amount of fluid, a fluid actuator within the ejection chamber operates to eject the fluid through an opening of the nozzle. The fluidic ejection dies and surrounding packaging may be referred to as a fluidic ejection device.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
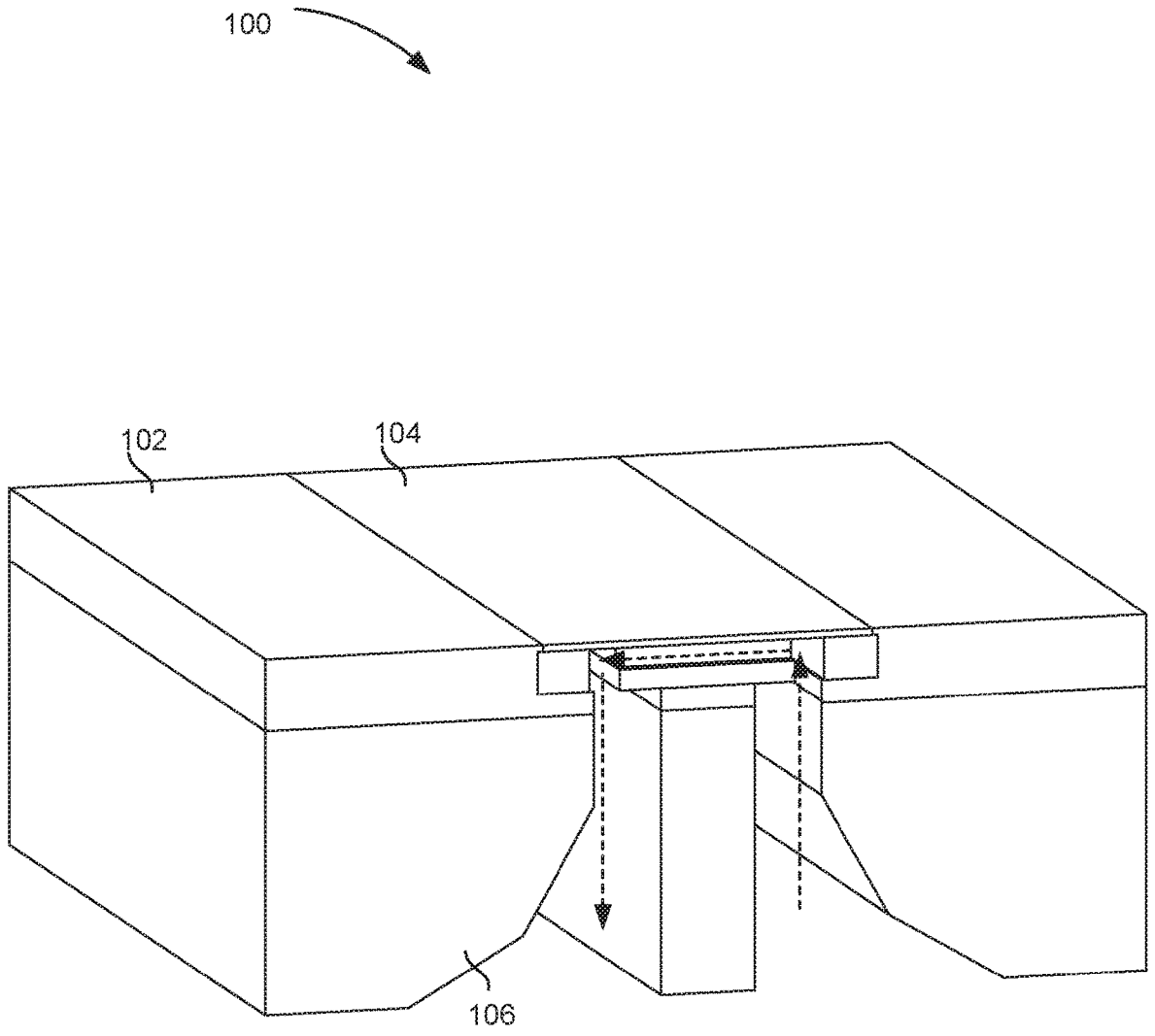
FIGS. 1A and 1B are isometric views of a fluidic ejection device with a fluidic ejection die with enclosed cross-channels, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic devices, as used herein, are devices that include fluidic dies. Fluidic dies may describe a variety of types of integrated devices with which small volumes of fluid may be pumped, mixed, analyzed, ejected, etc. Such fluidic dies may include fluidic ejection dies, additive manufacturing distributor components, digital titration components, and/or other such devices with which volumes of fluid may be selectively and controllably ejected. Other examples of fluidic dies include fluid sensor devices, lab-on-a-chip devices, and/or other such devices in which fluids may be analyzed and/or processed.

In a specific example, these fluidic devices are found in any number of printing systems such as inkjet printers, multi-function printers (MFPs), and additive manufacturing apparatuses. The fluidic devices in these printing systems are used for precisely, and rapidly, dispensing small quantities of fluid. For example, in an additive manufacturing apparatus, the fluid ejection device dispenses fusing agent. The fusing agent is deposited on a build material, which fusing agent facilitates the hardening of build material to form a three-dimensional product.

Other fluid ejection devices dispense ink on a two-dimensional print medium such as paper. For example, during inkjet printing, fluid is directed to a fluid ejection die found within a fluidic ejection device. Depending on the content to be printed, the system in which the fluid ejection die is disposed determines the time and position at which the ink drops are to be released/ejected onto the print medium. In this way, the die of the fluidic ejection device releases multiple ink drops over a predefined area to produce a representation of the image content to be printed. Besides paper, other forms of print media may also be used. Accordingly, as has been described, the systems and methods described herein may be implemented in two-dimensional printing, i.e., depositing fluid on a substrate, and in three-dimensional printing, i.e., depositing a fusing agent or other functional agent on a material base to form a three-dimensional printed product.

While such fluidic ejection devices have increased in efficiency in ejecting various types of fluid, enhancements to their operation can yield increased performance. For example, dies in fluidic ejection devices can include resistive elements which force fluid through nozzle openings. In some examples, the fluid may include suspended particles that may move out of suspension and collect as sediment in certain areas within the fluidic ejection die. For example, pigment particles suspended in ink may tend to move out of suspension and collect within the ejection chamber of a nozzle. This can block the ejection of fluid and/or result in decreased print quality.

This sedimentation of particles may be corrected by including a number of recirculation pumps disposed within micro-recirculation channels within the fluidic ejection die. The recirculation pumps may be micro-resistive elements that reduce or eliminate pigment settling by recirculating the fluid through the ejection chambers of the fluidic ejection die.

However, the addition of the recirculation pumps, as well as the operation of fluid ejectors may cause an undesirable amount of waste heat to accumulate within the fluid, the fluidic ejection die, and other portions of the overall fluid ejection device. This increase in waste heat may cause thermal defects in the ejection of the fluid from the fluid ejection die, damage components of the fluidic ejection die, and reduce print quality.

Also, the desirable impact of these micro-recirculation pumps is reduced due to fluid mechanics. For example, fluid is supplied to the fluidic ejection device via a fluid supply slot. A macro-recirculation system includes an external pump that drives fluid through these fluid supply slots. Due to the narrowness of the fluidic ejection die, this macro-recirculation flow may not penetrate deep enough into the fluid supply slot to be drawn into the micro-recirculation loop in the nozzle. That is, the fluid supply slot separates the macro-recirculation flow from the micro-recirculation flow.

Accordingly, the fluid in the micro-recirculation loop is not replenished, but instead the same volume of fluid is recycled through the loop. Doing so has a deleterious effect on the nozzles. For example, during operation, after a number of actuations via the micro-fluidic pumps and the fluid ejectors, portions of the fluid evaporate such that the fluid becomes depleted of water. Fluid that is depleted of water can negatively impact the nozzles and can result in reduced print quality.

Accordingly, the present specification describes a fluidic ejection device that solves these and other issues. That is, the present specification describes devices and methods that force flow into the fluidic ejection device, in a transverse direction. In this example, a die slot is replaced with an inlet port and an outlet port that are linked to enclosed cross-channels on the back of the fluidic ejection die. More specifically, nozzles through which fluid is ejected are disposed on a front surface of the fluidic ejection die. Fluid is supplied to these nozzles via the backside. The enclosed cross-channels promote flow closer to the fluidic ejection die. That is, without the enclosed cross channels, fluid that is supplied to an inlet of the fluidic ejection device by the supply slots has a low velocity, insufficient to come close to the micro-recirculation loops. In this example, fluid is circulating throughout the microfluidic loops, but the fluid is not replenished from the fluid supply.

The enclosed cross-channels, via fluid dynamics, increase the flow close to the micro-recirculation loops such that they are replenished with new fluid. That is, the micro-recirculation flow draws fluid from, and ejects fluid into a macro-recirculation flow traveling through the enclosed cross-channels. Accordingly, in this example, the micro-recirculation loop and nozzles are provided with new, fresh fluid.

That is, a micro-recirculation pump draws fluid into, and ejects fluid out of, passages in a pulsating manner that creates secondary flows and vortices. These vortices dissipate a certain distance from the passages. The enclosed cross-channels draw the macro-recirculating flow directly to these vortices such that the macro-recirculating fluid interacts with these vortices at sufficient flow velocity so that mixing between the macro-recirculating fluid and the fluid in the micro-recirculation loop is accelerated, Without the enclosed cross-channels to force the macro-recirculating fluid to close proximity of the micro-recirculation loops, the macro-recirculating fluid will not reach into a fluid supply slot with sufficient velocity to interact with the vortices around entrances/exits of the micro-recirculation loop. This increased flow also enhances cooling as fresh ink is more effective at drawing heat from the fluidic ejection die than is depleted, or recycled, fluid.

The fluidic ejection device also includes a moldable material in which the fluidic ejection die is disposed. This moldable material, allows integration of circuitry into the molding, without increasing the thickness of the device near the die. In other words, embedding the fluidic ejection die in a moldable material decouples a size of the ejection die from the size of the size of the carrier substrate and associated features. Placing the fluidic ejection die in the moldable material allow allows fluidic fan-out of the fluidic ejection die, provides a smooth planar surface on the nozzle side of the fluidic ejection die which prevents media from catching on protrusions or gaps; allows electrical fan-out, and simplifies assembly by aligning multiple fluidic ejection dies and fixing their position within the moldable material.

Specifically, the present specification describes a fluidic ejection device. The fluidic ejection device includes a fluidic ejection die embedded in a moldable material. The fluidic ejection die includes an array of nozzles to eject an amount of fluid. Each nozzle includes an ejection chamber to hold an amount of fluid; an opening to dispense the amount of fluid; and a fluid actuator, disposed within the ejection chamber, to eject the amount of fluid through the opening. The fluidic ejection die also includes an array of passages, formed in a substrate, to deliver fluid to and from the ejection chambers. The fluidic ejection die also includes an array of enclosed cross-channels, formed on a back surface of the substrate. Each enclosed cross-channel of the array of enclosed cross-channels is fluidly connected to a respective plurality of passages of the array of passages. In addition to the fluidic ejection die, the fluidic ejection device includes the moldable material in which the fluidic ejection die is disposed. The moldable material includes supply slots to deliver fluid to and from the fluidic ejection die. A carrier substrate of the fluidic ejection device supports the fluidic ejection die and the moldable material.

The present specification also describes a printhead. The printhead includes a molded panel formed of a moldable material. The printhead also includes a plurality, for example, more than one, fluidic ejection die embedded in the molded panel. Each fluidic ejection die includes an array of nozzles to eject an amount of fluid. Each nozzle includes an ejection chamber to hold the amount of fluid, an opening to dispense the amount of fluid, and a fluid actuator, disposed within the ejection chamber, to eject the amount of fluid through the opening. The fluidic ejection die also includes 1) an array of passages formed on a substrate to deliver fluid to and from ejection chambers and 2) an array of enclosed cross-channels, formed on a back surface of the substrate. Each enclosed cross-channel of the array of enclosed cross-channels is fluidly connected to a respective plurality of passages of the array of passages. The molded panel includes supply slots to deliver fluid to and from the fluidic ejection die. A carrier substrate of the fluidic ejection device supports the fluidic ejection die and the molded panel.

The present specification also describes a method for making a fluidic ejection device. According to the method, an array of nozzles and corresponding passages through which fluid is ejected are formed. A number of enclosed cross-channels are also formed. Each enclosed cross-channel of the array of enclosed cross-channels is fluidly connected to a respective plurality of passages of the array of passages. The array of nozzles and passages are then joined to the number of enclosed cross-channels to form a fluidic ejection die and the fluidic ejection die is embedded into a moldable material. The moldable material includes supply slots that provide fluid to the number of enclosed cross-channels.

In summary, using such a fluidic ejection die 1) reduces the likelihood of decap by maintaining water concentration in the fluid, 2) facilitates more efficient micro-recirculation within the nozzles, 3) improves nozzle health, 4) provides fluid mixing near the die to increase print quality, 5) convectively cools the fluidic ejection die, 6) removes air bubbles from the fluidic ejection die, 7) allows for re-priming of the nozzle, and 8) allows for sliver fluidic ejection dies to be used. However, it is contemplated that the devices disclosed herein may address other matters and deficiencies in a number of technical areas.

As used in the present specification and in the appended claims, the term "actuator" refers a nozzle or another non-ejecting actuator. For example, a nozzle, which is an actuator, operates to eject fluid from the fluidic ejection die. A recirculation pump, which is an example of a non-ejecting actuator, moves fluid through the passages, channels, and pathways within the fluidic ejection die.

Accordingly, as used in the present specification and in the appended claims, the term "nozzle" refers to an individual component of a fluidic ejection die that dispenses fluid onto a surface. The nozzle includes at least an ejection chamber, an ejector fluid actuator, and a nozzle opening.

Further, as used in the present specification and in the appended claims, the term "printing fluid cartridge" may refer to a device used in the ejection of ink, or other fluid, onto a print medium. In general, a printing fluid cartridge may be a fluidic ejection device that dispenses fluid such as ink, wax, polymers or other fluids. A printer cartridge may include fluidic ejection dies. In some examples, a printer cartridge may be used in printers, graphic plotters, copiers and facsimile machines. In these examples, a fluidic ejection die may eject ink, or another fluid, onto a medium such as paper to form a desired image.

Even further, as used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Figure 1B:
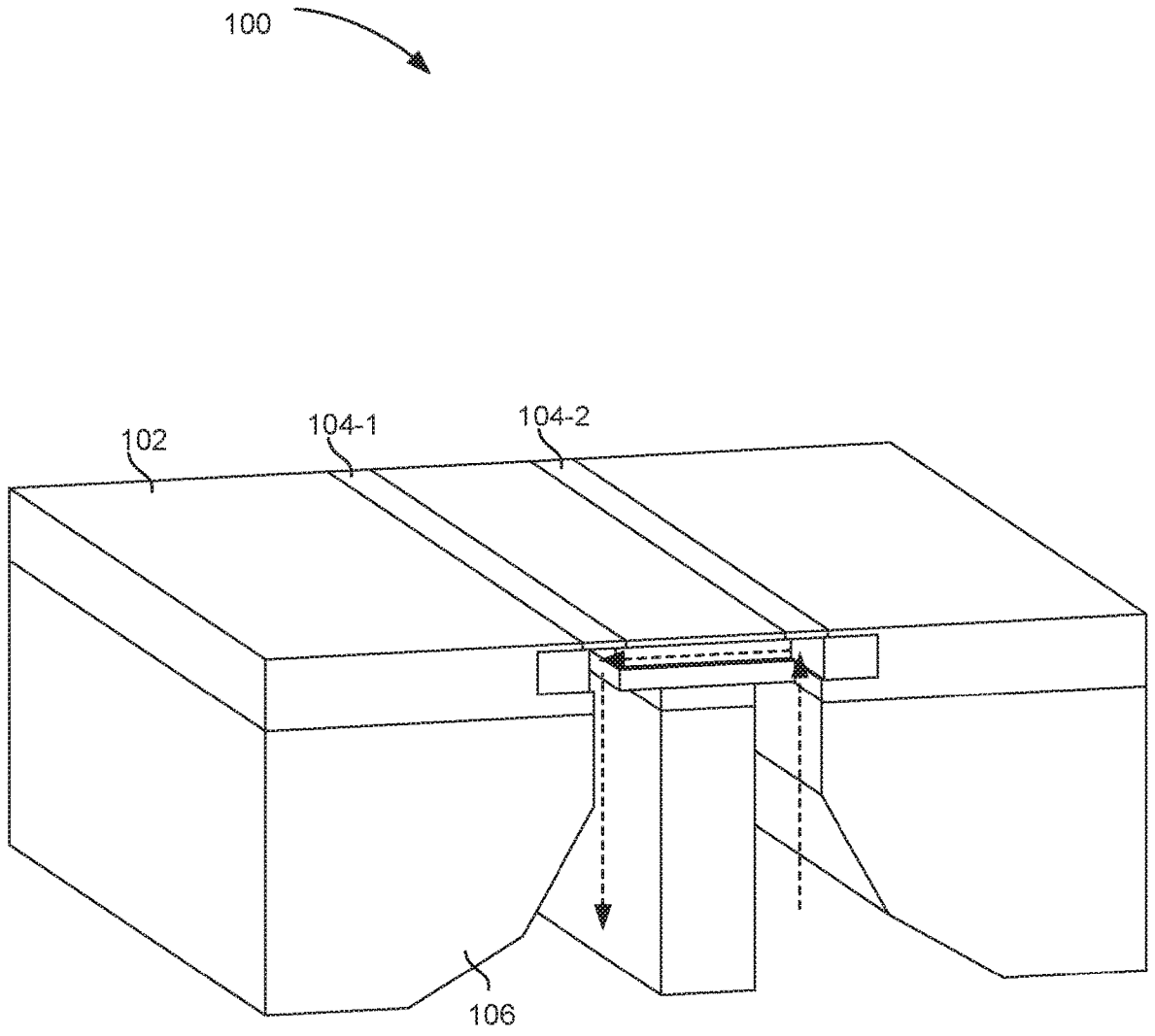

Turning now to the figures, FIGS. 1A and 1B are isometric views of a fluidic ejection device (100) with a fluidic ejection die with enclosed cross-channels, according to an example of the principles described herein. Specifically, FIG. 1A is a view of a fluidic ejection device (100) with a single fluidic ejection die as defined by the nozzle plate (104) and FIG. 1B is a view of a fluidic ejection device (100) with multiple fluidic ejection dies as defined by the nozzle plates (104-1, 104-2).

In some examples, the fluid ejection device (100) includes a fluid ejection die that is embedded in a moldable material (102). As described above, the fluid ejection die is a component of a fluid ejection device (100) that operates to eject fluid originating from a reservoir onto a surface. Accordingly, the fluidic ejection die includes a number of components to facilitate this ejection. Specifically, the fluidic ejection die includes an array of nozzles, Each nozzle includes an ejection chamber and an opening that are defined in a nozzle substrate (104). A fluid actuator is disposed within the ejection chamber to eject fluid from the ejection chamber through the opening. The fluidic ejection die also includes an array of passages that are formed in a substrate. The array of passages deliver fluid to and from the ejection chamber. An array of enclosed cross-channels are formed on a back surface of the substrate and direct the fluid from a fluid supply slot to the passages. That is, each enclosed cross-channel is fluidly connected to a respective plurality of passages of the array of passages. As described above, the enclosed cross-channels draw fluid from the fluid supply slot closer to the fluidic ejection die such that it mixes more thoroughly with the fluid flowing through the nozzle. This increased mixing at least 1) prolongs the life of the nozzles, 2) increases die cooling, and 3) increases print quality.

Returning to the fluidic ejection die in general. In some examples, the fluidic ejection die is a sliver die that is thin, for example, less than 220 micrometers wide. The dimensions of the fluidic ejection die may relate to one another using an aspect ratio, the aspect ratio being the ratio of the width of the fluidic ejection die to the length of the fluidic ejection die. The fluidic ejection die of the present application may have an aspect ratio of less than 1:3. In other words, the length of the fluidic ejection die may be at least 3 times greater, and in some cases greater than 50 times, than a width of the fluidic ejection die. In another example the length of the fluidic ejection die may be at least 100 times greater than a width of the fluidic ejection die. As a specific numeric example, the fluidic ejection die may be less than 220 micrometers wide and longer than 20 millimeters.

In one example, the fluidic ejection die may be compression molded into a monolithic body of plastic, epoxy mold compound (EMC), or other moldable material (102). For example, a printing system may include a fluidic ejection device (102) with multiple fluidic ejection dies molded into an elongated, singular molded body as indicated in FIG. 1B. The molding of the fluid ejection dies within the moldable material (102) enables the use of smaller dies by offloading the fluid delivery channels from the fluid ejection die to the molded material (102) body. In this manner, the molded material (102) body effectively grows the size of each fluidic ejection die, which, in turn, improves fan-out of the fluidic ejection die for making external fluid connections and for attaching the fluidic ejection dies to other structures. To enable delivery of fluid from a fluid supply to the passages of the fluidic ejection die, the moldable material (102) in which the fluidic ejection die is disposed includes supply slots. A carrier substrate (106) of the fluidic ejection device (100) supports both the fluidic ejection die and the moldable material (102).

Figure 2A:
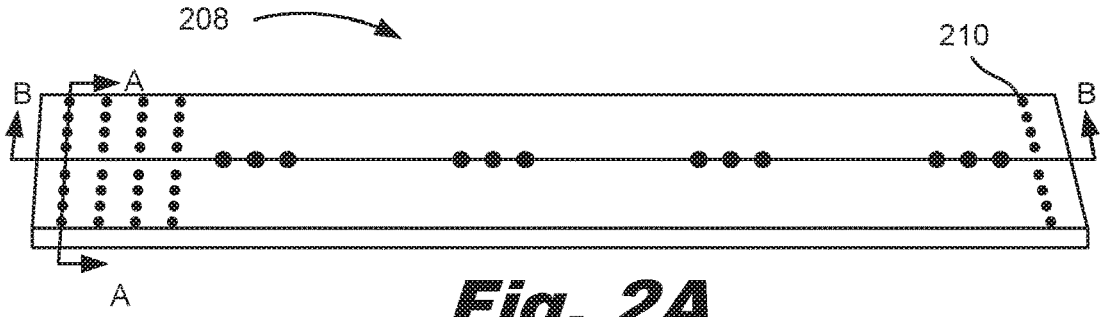
FIGS. 2A-2D are views of a fluidic ejection die with enclosed cross-channels, according to an example of the principles described herein.

FIGS. 2A-2D are views of a fluidic ejection die (208) with enclosed cross-channels (212), according to an example of the principles described herein. Specifically, FIG. 2A is an isometric view of the fluidic ejection die (208). As described above, the fluidic ejection die (208) refers to a component of a fluidic ejection device (FIG. 1, 100) that includes components to eject fluid originating from a reservoir onto a substrate or other surface. To eject the printing fluid onto the substrate, the fluidic ejection die (208) includes an array of nozzles (210). For simplicity in FIG. 2A, one nozzle (210) has been indicated with a reference number. Moreover, it should be noted that the relative size of the nozzles (210) and the fluidic ejection die (208) are not to scale, with the nozzles being enlarged for purposes of illustration.

The nozzles (210) of the fluidic ejection die (208) may be arranged in columns or arrays such that properly sequenced ejection of fluid from the nozzles (210) causes characters, symbols, and/or other graphics or images to be printed on the print medium as the fluidic ejection die (208) and print medium are moved relative to each other.

In one example, the nozzles (210) in the array may be further grouped. For example, a first subset of nozzles (210) of the array may pertain to one color of ink, or one type of fluid with a set of fluidic properties, while a second subset of nozzles (210) of the array may pertain to another color of ink, or fluid with a different set of fluidic properties.

The fluidic ejection die (208) may be coupled to a controller that controls the fluidic ejection die (208) in ejecting fluid from the nozzles (210). For example, the controller defines a pattern of ejected fluid drops that form characters, symbols, and/or other graphics or images on the print medium. The pattern of ejected fluid drops is determined by the print job commands and/or command parameters received from a computing device.

Figure 2B:
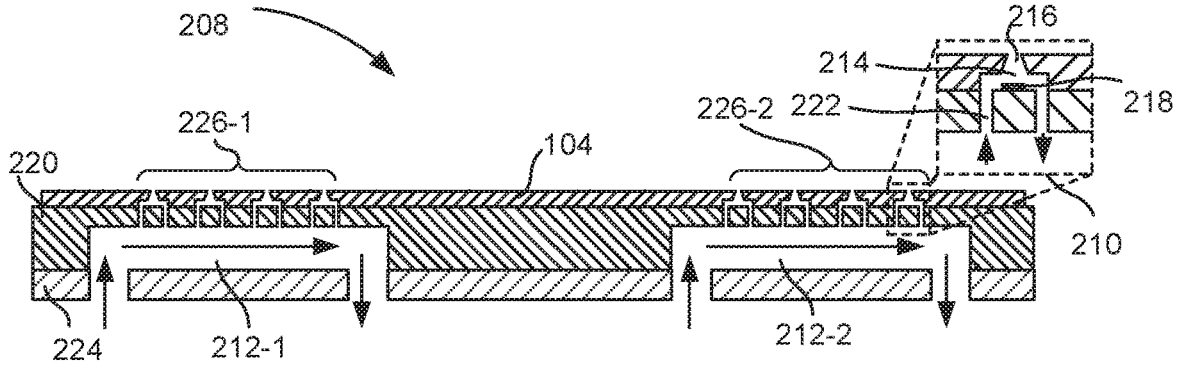
Figure 2C:
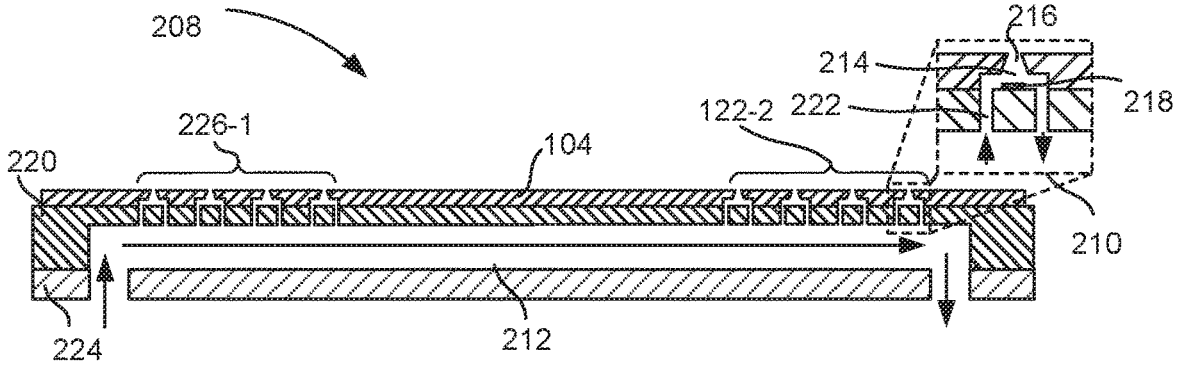

FIGS. 2B and 2C are cross-sectional views of the fluidic ejection die (208). More specifically, FIGS. 2B and 2C are cross-sectional views taken along the line A-A in FIG. 2A. FIG. 2B and FIG. 2C each illustrate a particular type of enclosed cross-channel (212). Note that in FIGS. 2B and 2C, the reference numbers 212 refers to the enclosed cross-channel and not the fluid flow, which fluid flow indicated by the arrows.

Among other things, FIGS. 2B and 2C depict a nozzle (210) of the array. For simplicity, one nozzle (210) in FIGS. 2B and 2C is depicted with a reference number. To eject fluid, the nozzle (210) includes a number of components. For example, a nozzle (210) includes an ejection chamber (214) to hold an amount of fluid to be ejected, an opening (216) through which the amount of fluid is ejected, and an ejecting fluid actuator (218), disposed within the ejection chamber (214), to eject the amount of fluid through the opening (216). The ejection chamber (214) and nozzle opening (216) may be defined in a nozzle substrate (104) that is deposited on top of a channel substrate (220). In some examples, the nozzle substrate (104) is formed of SU-8 or other material.

Turning to the ejecting actuators (218), the ejecting fluid actuator (218) may include a firing resistor or other thermal device, a piezoelectric element, or other mechanism for ejecting fluid from the ejection chamber (214). For example, the ejector (218) may be a firing resistor. The firing resistor heats up in response to an applied voltage. As the firing resistor heats up, a portion of the fluid in the ejection chamber (214) vaporizes to form a bubble. This bubble pushes fluid out the opening (216) and onto the print medium. As the vaporized fluid bubble pops, fluid is drawn into the ejection chamber (214) from a passage (222), and the process repeats. In this example, the fluidic ejection die (208) may be a thermal inkjet (TIJ) fluidic ejection die (208).

In another example, the ejecting fluid actuator (218) may be a piezoelectric device. As a voltage is applied, the piezoelectric device changes shape which generates a pressure pulse in the ejection chamber (214) that pushes the fluid out the opening (216) and onto the print medium. In this example, the fluidic ejection die (208) may be a piezoelectric inkjet (PIJ) fluidic ejection die (208).

The fluidic ejection die (208) also includes an array of passages (222) that are formed in a channel substrate (220). The passages (222) deliver fluid to and from the corresponding ejection chamber (214). In some examples, the passages (222) are formed in a perforated membrane of the channel substrate (220). For example, the channel substrate (220) may be formed of silicon, and the passages (222) may be formed in a perforated silicon membrane that forms part of the channel substrate (220). That is, the membrane may be perforated with holes which, when joined with the nozzle substrate (104), align with the ejection chamber (214) to form paths of ingress and egress of fluid during the ejection process. As depicted in FIGS. 2B and 2C, two passages (222) may correspond to each ejection chamber (214) such that one passages (222) of the pair is an inlet to the ejection chamber (214) and the other passages (222) is an outlet from the ejection chamber (214). In some examples, the passages (222) may be round holes, square holes with rounded corners, or other type of passage.

The fluidic ejection die (208) also includes an array of enclosed cross-channels (212).

The enclosed cross-channels (212) are formed on a backside of the channel substrate (220) and deliver fluid to and from the passages (222). In one example, each enclosed cross-channel (212) is fluidly connected to a respective plurality of passages (222) of the array of passages (222). In some examples, the fluid path through the enclosed cross-channel (212) is perpendicular to the flow through the passages (222) as indicated by the arrows. That is, fluid enters an inlet, passes through the enclosed cross-channel (104), passes to respective passages (222), and then exits an outlet to be mixed with other fluid in the associated fluidic delivery system. The flow through the inlet, enclosed cross-channel (212) and outlet is indicated by arrows in FIGS. 2B and 20.

Figure 2D:
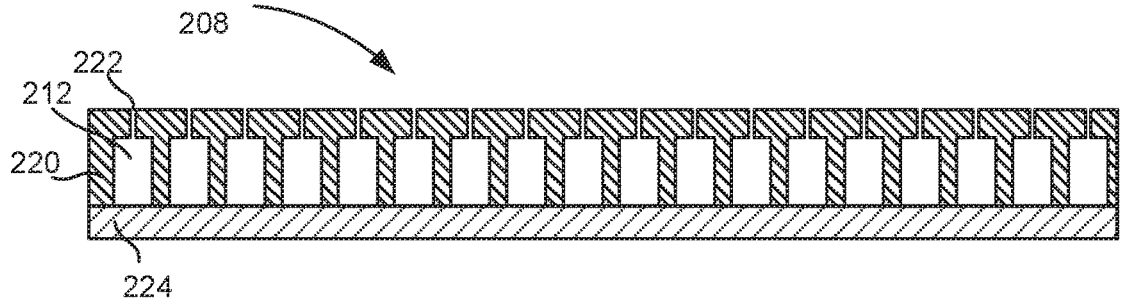

The enclosed cross-channels (212) are defined by any number of surfaces. For example, one surface of an enclosed cross-channel (212) is defined by the membrane portion of the channel substrate (220) in which the passages (222) are formed. Another surface is defined by a lid substrate (224) and the other surfaces are defined by ribs as indicated in FIG. 2D.

The individual cross-channels (212) of the array may correspond to passages (222) and corresponding ejection chambers (214) of a particular row. For example, as depicted in FIG. 2A, the array of nozzles (210) may be arranged in rows, and each cross-channel (212) may align with a row, such that nozzles (210) in a row share the same cross-channel (212). While FIG. 2A depicts the rows of nozzles (210) in a straight line, the rows of nozzles (210) may be angled, curved, chevron-shaped, or otherwise oriented. Accordingly, in these examples, the enclosed cross-channels (212) may be similarly, angled, curved, chevron-shaped, or otherwise oriented to align with the arrangement of the nozzles (210). In another example, passages (222) of a particular row may correspond to multiple cross-channels (212). That is, the rows may be straight, but the enclosed cross-channels (212) may be angled. While specific reference is made to an enclosed cross-channel (212) per row of nozzles (210), in some examples, multiple rows of nozzles (210) may correspond to a single enclosed cross-channel (212).

In some examples, the enclosed cross-channels (212) deliver fluid to rows of different subsets of the array of passages (222). For example, as depicted in FIG. 2C, a single enclosed cross-channel (212) may deliver fluid to a row of nozzles (210) in a first subset (226-1) and a row of nozzles (210) in a second subset (226-2). In this example, one type of fluid, for example, one ink color, can be provided to the different subsets (226). In a specific example, a mono-chrome fluidic ejection die (208) may implement one enclosed cross-channel (212) across multiple subsets (226) of nozzles (210).

In some examples, the enclosed cross-channels (212) deliver fluid to rows of a single subset (226) of the array of passages (222). For example, as depicted in FIG. 2B, a first cross-channel (212-1) delivers fluid to a row of nozzles (210) in a first subset (226-1) and a second cross-channel (212-2) delivers fluid to a row of nozzles (210) in a second subset (226-2). In this example, different types of fluid, for example, different ink colors, can be provided to the different subsets (226). Such fluidic ejection dies (208) may be used in multi-color printing fluid cartridges.

These enclosed cross-channels (212) promote increased fluid flow through the fluidic ejection die (208). For example, without the enclosed cross-channels (212), fluid passing on a backside of the fluidic ejection die (208) may not pass close enough to the passages (222) to sufficiently mix with fluid passing through the nozzles (210). However, the enclosed cross-channels (212) draw fluid closer to the nozzles (210) thus facilitating greater fluid mixing. The increased fluid flow also improves nozzle health as used fluid is removed from the nozzles (210), which used fluid, if recycled throughout the nozzle (210), can damage the nozzle (210).

FIG. 2D is a cross-sectional views of the fluidic ejection die (208). More specifically, FIG. 2D is a cross-sectional view taken along the line B-B in FIG. 2A. FIG. 2D depicts a number of enclosed cross-channels (212) along the length of a fluidic ejection die (208). While FIG. 2D depicts a certain number of enclosed cross-channels (212), the fluidic ejection die (208) may include any number of these enclosed cross-channels (212).

Figure 3:
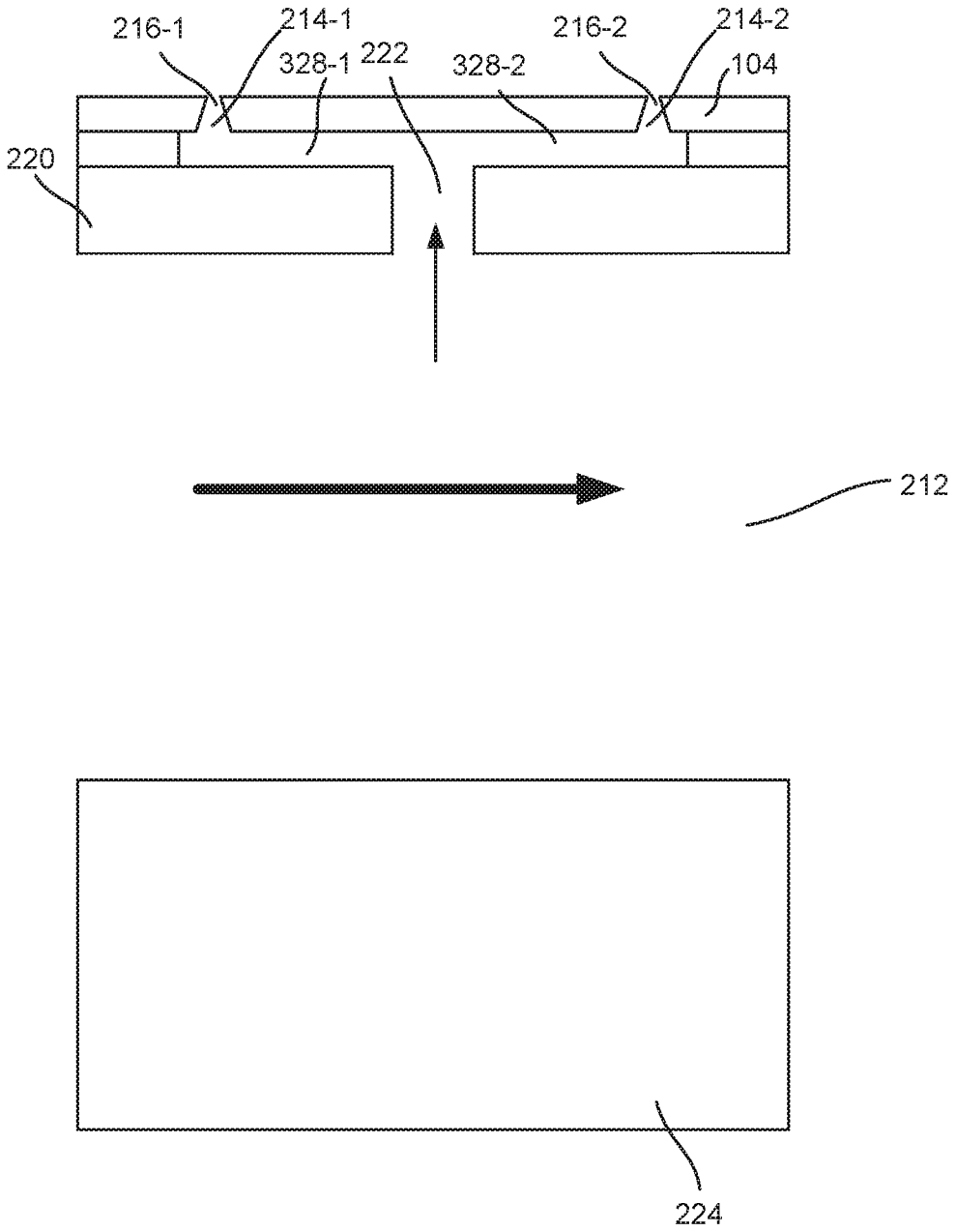
FIG. 3 is a cross-sectional view of a fluidic ejection die with enclosed cross-channels, according to an example of the principles described herein.

FIG. 2D also depicts passages (222) through which fluid is passed to an ejection chamber (214). For simplicity, a single instance of the passage (222) and enclosed cross-channel (212) are depicted with reference numbers. While FIG. 2D illustrates the ribs that in part define the enclosed cross-channels (212) as being formed from the channel substrate (220), in some examples, the enclosed cross-channels may be formed from the lid substrate (224) which lid substrate (224) may be formed of glass, silicon, or other material, FIG. 3 is a cross-sectional view of a fluidic ejection die (FIG. 2A, 208) with enclosed cross-channels (212), according to an example of the principles described herein. Specifically, FIG. 3 depicts a portion of the enclosed cross-channel (212) that passes underneath a single passage (222). Note that the elements depicted in FIG. 3 are not drawn to scale, and are enlarged for illustration purposes. FIG. 3 clearly depicts the fluid flow through the enclosed cross-channel (212) and the passage (222). As depicted, such fluid flow is perpendicular. That is, as the fluid flows through the enclosed cross-channel (212), it changes direction perpendicularly as it passes through the passage (222) to be directed to the nozzles (FIG. 2A, 210).

In some examples, in addition to the ejecting fluid actuators (FIG. 2B, 218), ejection chambers (214-1, 214-2), and openings (216-1, 216-2), each nozzle (FIG. 2A, 210) may include a channel (328-1, 328-2) to direct fluid to and from the corresponding ejection chambers (214). Such channels (328) may be of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). In this example, the channels (328-1, 328-2) and the passages (222) that correspond to the nozzle (FIG. 2A, 210) form a micro-recirculation loop. In some examples, a pump fluid actuator is disposed within a channel (328) to move the fluid to and from the ejection chamber (214). Such micro-channels (328-1, 328-2) prevent sedimentation of the fluid passing there through and ensures that fresh fluid is available for ejection through the opening (216). The fluid actuators, both the ejectors (FIG. 2B, 218) and the pump actuators may be electrostatic membrane actuator, a mechanical/impact driven membrane actuator, a magnetostrictive drive actuator, or other such elements that may cause displacement of fluid responsive to electrical actuation.

As described above, such micro-recirculation loops provide fresh fluid to the ejection chamber (214), thus increasing the effective life of a nozzle (FIG. 2A, 210). This is because the nozzles (FIG. 2A, 210) operate best when provided with fresh fluid.

Figure 4A:
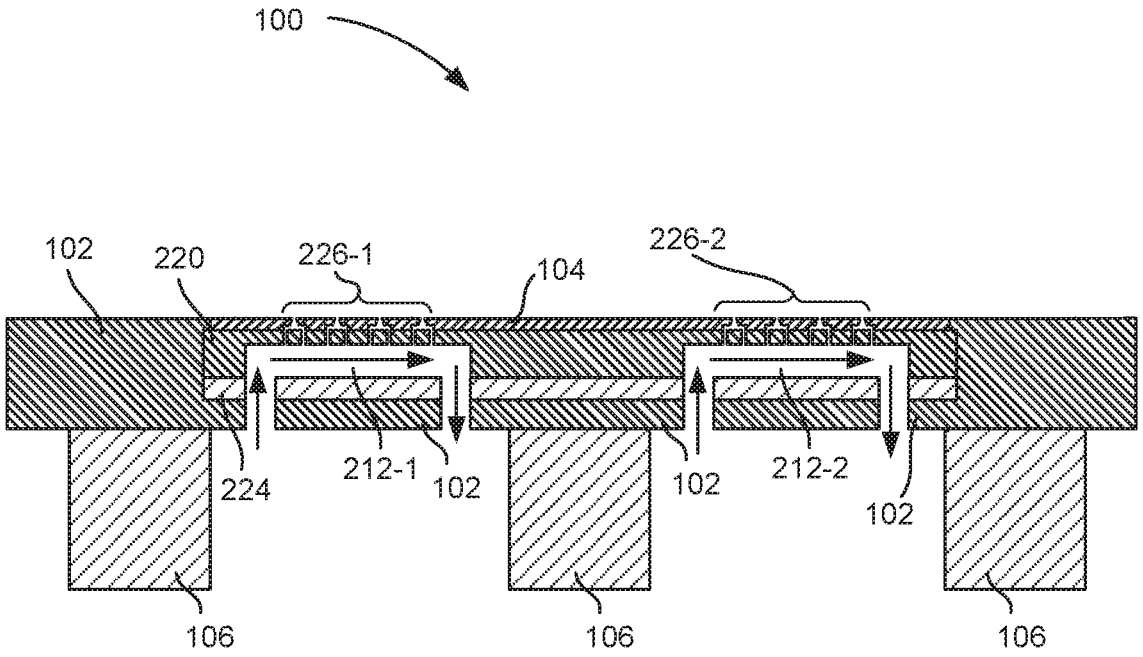
FIGS. 4A and 4B are cross-sectional views of a fluidic ejection device with a fluidic ejection die with enclosed cross-channels, according to an example of the principles described herein.
Figure 4B:
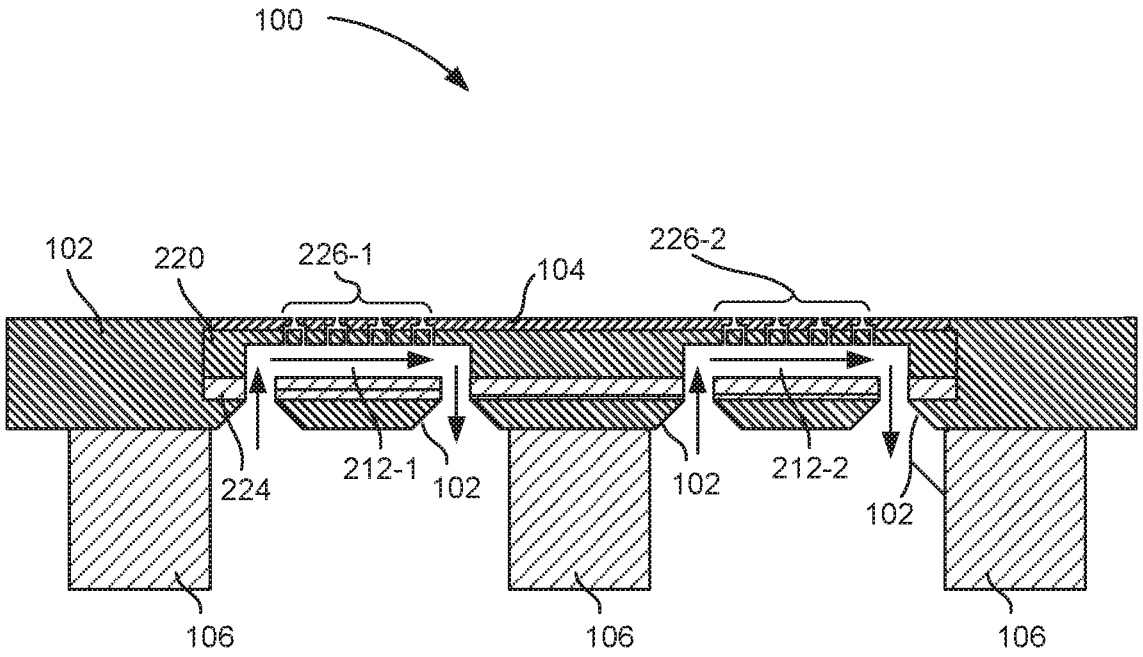

FIGS. 4A and 4B are cross-sectional views of a fluidic ejection device (100) with a fluidic ejection die (FIG. 2A, 208) with enclosed cross-channels (FIG. 2B, 212), according to an example of the principles described herein. Specifically, FIG. 4A depicts a fluidic ejection device (100) with straight fluid supply slots and FIG. 4B depict a fluidic ejection device (100) with fluid supply slots that are tapered. As noted above, the moldable material (102) allows for the tapering out of the fluid supply slots which allows narrower fluidic ejection dies (08) such as sliver dies to be implemented in a corresponding printing device.

FIGS. 4A and 4B depict cases where different enclosed cross-channels (212-1, 212-2) are supplying fluid, which may be different from one another, to different subsets (226-1, 226-2) of nozzles (FIG. 2A, 210). FIGS. 4A and 4B also depict the embedding of the fluidic ejection die (FIG. 2A, 208) into the moldable material (102). FIGS. 4A and 4B also depict the supply slots in the moldable material (102) through which the fluid passes to inlets and outlets fluidly connected to the passages (FIG. 2B, 222), which supply slots in FIG. 4B being fanned-out. In some cases, the supply slots of the moldable material (102) may be defined by an insert of the moldable material (102) that is deposited underneath the lid substrate (224). These supply slots may be elongated such that they provide fluid to multiple enclosed cross-channels (FIG. 2B, 212). FIGS. 4A and 4B also clearly depicts the carrier substrate (106) that supports the moldable material (102), fluidic ejection die (FIG. 2A, 208), and overall fluidic ejection device (100).

FIGS. 4A and 4B also depict a fanning-out of the carrier substrate (106). That is, the carrier substrate (106) outer ribs are located beyond a width of the die (220). That is, the moldable material (106) effectively widens the fluidic interface to the fluidic ejection die without physically widening the fluidic ejection die itself. This allows for a smaller, and more cost-effective fluidic ejection die to be used.

Figure 5:
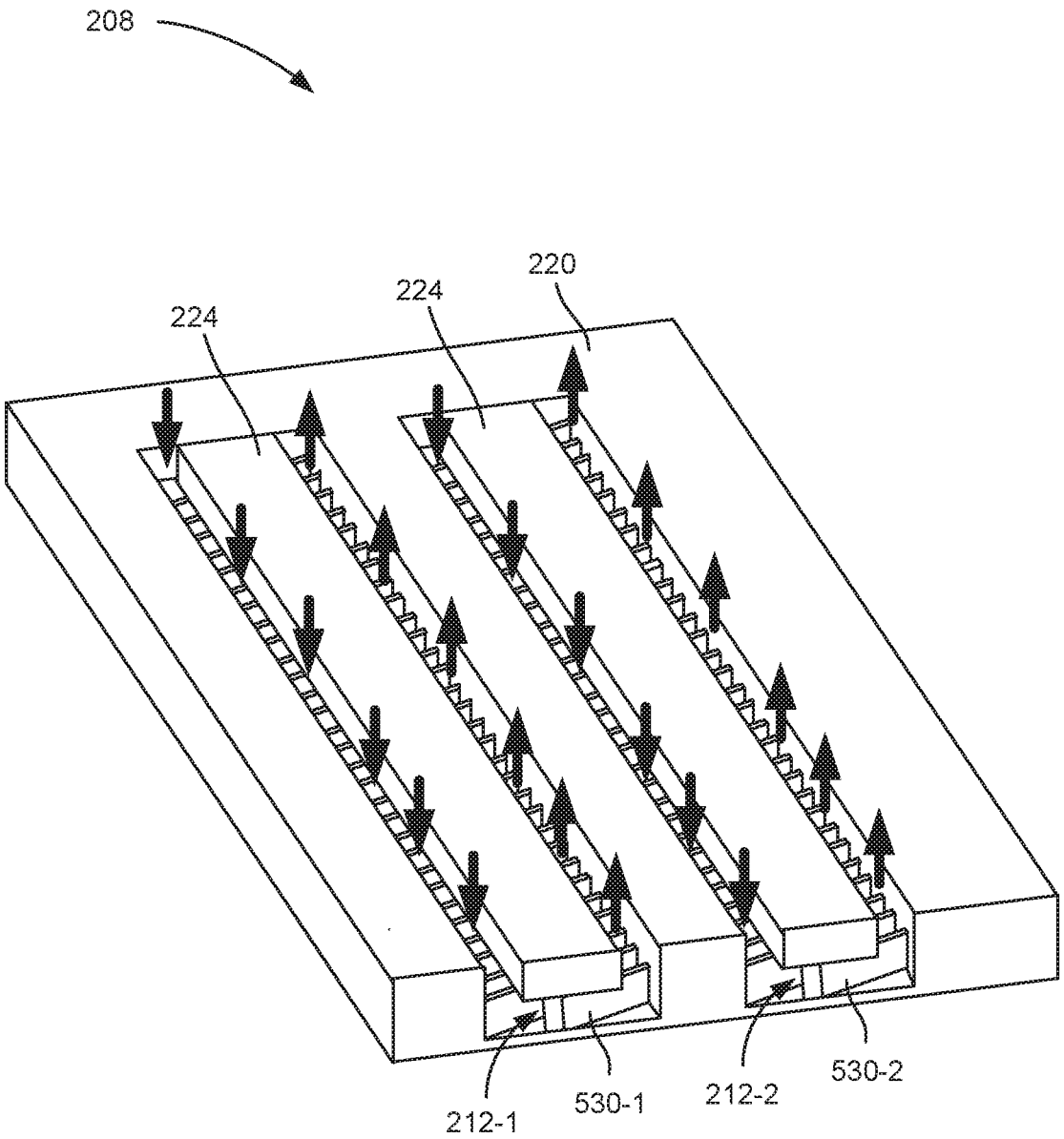
FIG. 5 is an isometric view of an underside of a fluidic ejection die with enclosed cross-channels, according to an example of the principles described herein.

FIG. 5 is an isometric view of an underside of a fluidic ejection die (208) with enclosed cross-channels (212-1, 212-2), according to an example of the principles described herein. For simplicity, a few instances of enclosed cross-channels (212-1, 212-2) and associated ribs (530-1, 530-2) are indicated with reference numbers.

FIG. 5 clearly depicts the fluid flow path through the fluidic ejection die (208), specifically, through the enclosed cross-channels (212). In the example depicted in FIG. 5, the array of nozzles (FIG. 2A, 210) may be divided into two subsets (FIG. 2B, 226-1, 226-2), however the array of nozzles (FIG. 2A, 210) may be divided into any number of subsets (FIG. 2B, 226).

In this example, fluid is passed into an inlet, which inlet may be shared by a number of enclosed cross-channels (212). The fluid then passes into the enclosed cross-channels (212), which enclosed cross-channels (212) are defined in part by ribs (530-1, 530-1) and the lid substrate (224). As fluid flows through the enclosed cross-channels (212) it is directed through the passages (FIG. 2B, 222) and nozzles (FIG. 2A, 210), which nozzles (FIG. 2A, 210) may include micro-recirculation loops. Excess fluid is then transported back to the enclosed cross-channels (212) where it is expelled out an outlet of the enclosed cross-channels (212).

Figure 6:
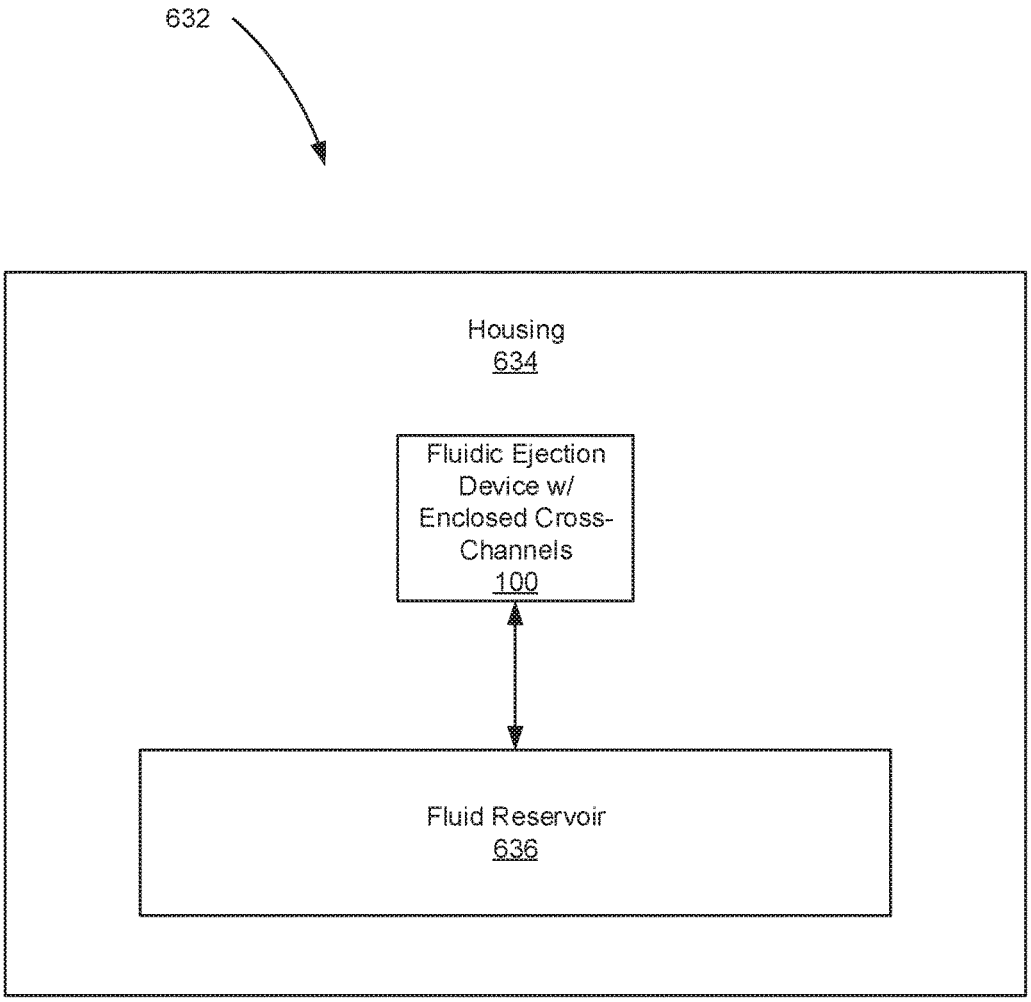
FIG. 6 is a block diagram of a printing fluid cartridge including a fluidic ejection die with enclosed cross-channels, according to an example of the principles described herein.

FIG. 6 is a block diagram of a printing fluid cartridge (632) including a fluidic ejection device (100) with enclosed cross-channels (FIG. 2B, 212), according to an example of the principles described herein. The printing fluid cartridge (632) is used within a printing system to eject a fluid. In some examples, the printing fluid cartridge (632) may be removable from the system for example, as a replaceable cartridge (632). In some examples, the printing fluid cartridge (632) is a substrate-wide printbar and the array of fluidic ejection devices (100) are grouped into printheads that are staggered across a width of a substrate on which the fluid is to be deposited. An example of such a printhead is depicted in FIG. 8.

The printing fluid cartridge (632) includes a housing (634) to house components of the printing fluid cartridge (632), The housing (634) houses a fluid reservoir (636) to supply an amount of fluid to the fluidic ejection device (100). In general, fluid flows between the reservoir (636) and the fluidic ejection device (100). In some examples, a portion of the fluid supplied to fluidic ejection device (100) is consumed during operation and fluid not consumed during printing is returned to the fluid reservoir (636). In some examples, the fluid may be ink. In one specific example, the ink may be a water-based ultraviolet (UV) ink, pharmaceutical fluid, or 3D printing material, among other fluids.

Figure 7:
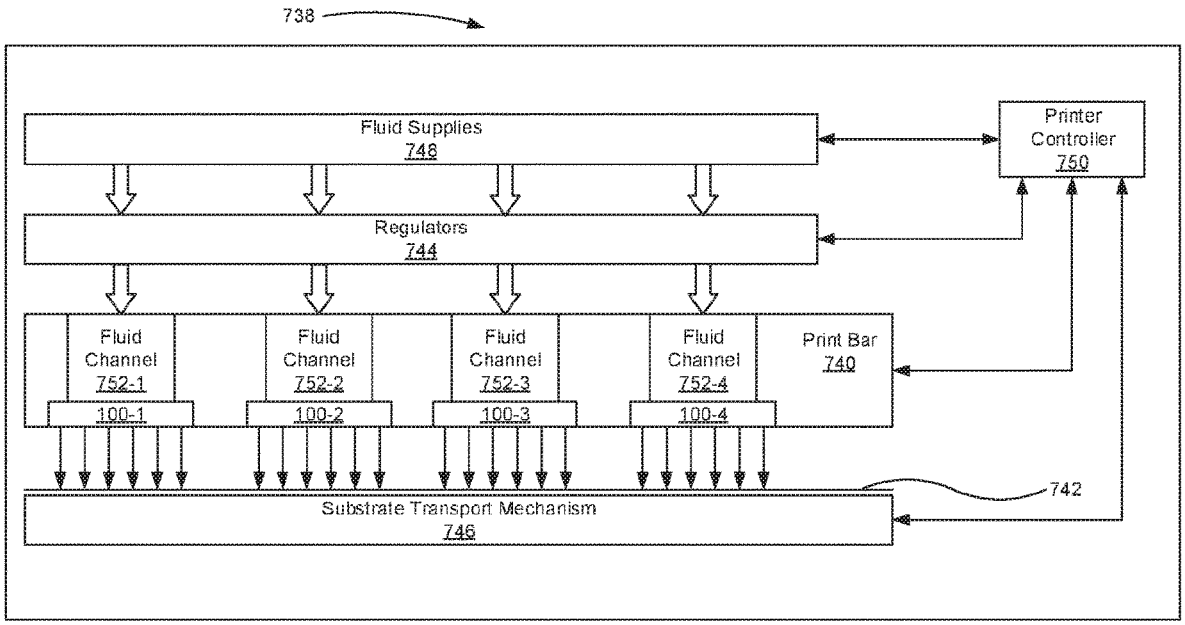
FIG. 7 is a block diagram of a printing device including a number of fluidic ejection dies with enclosed cross-channels in a substrate wide print bar, according to an example of the principles described herein.

FIG. 7 is a block diagram of a printing device (738) including a number of fluidic ejection devices (100-1, 100-2, 100-3, 100-4) with enclosed cross-channels (FIG. 2B, 212) in a substrate wide print bar (740), according to an example of the principles described herein. The printing device (738) may include a printbar (740) spanning the width of a print substrate (742), a number of flow regulators (744) associated with the printbar (740), a substrate transport mechanism (746), printing fluid supplies (748) such as a fluid reservoir (FIG. 6, 636), and a controller (750). The controller (750) represents the programming, processor(s), and associated memories, along with other electronic circuitry and components that control the operative elements of the printing device (738). The print bar (740) may include an arrangement of fluidic ejection devices (100) for dispensing fluid onto a sheet or continuous web of paper or other print substrate (742). Each fluid ejection device (100) receives fluid through a flow path that extend from the fluid supplies (748) into and through the flow regulators (744), and through a number of transfer molded fluid channels (752) defined in the print bar (740).

Figure 8:
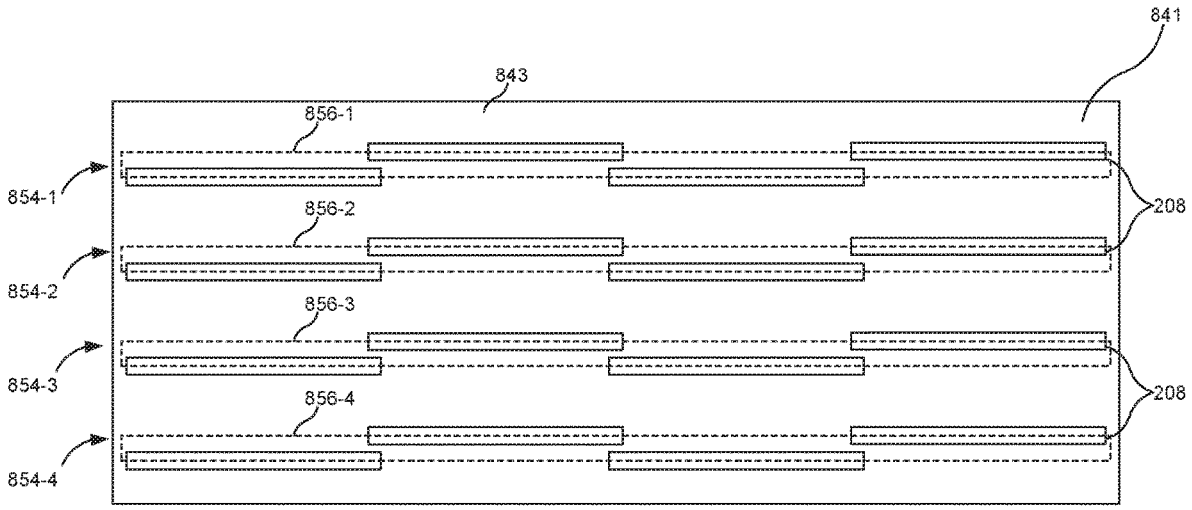
FIG. 8 is a block diagram of a fluidic ejection die including a number of fluidic ejection dies with enclosed cross-channels, according to an example of the principles described herein.

FIG. 8 is a block diagram of a fluidic ejection device (841) including a number of fluidic ejection dies (208) with enclosed cross-channels (FIG. 2A, 212), according to an example of the principles described herein. In some examples, the fluid ejection dies (208) are embedded in an elongated, monolithic molded panel (843) formed of the moldable material (102) and arranged end to end in a number of rows (854). The fluid ejection dies (208) are arranged in a staggered configuration in which the fluid ejection dies (208) in each row (854) overlap another fluid ejection dies (208) in that same row (854). In this arrangement, each row (854) of fluid ejection dies (208) receives fluid from a different transfer molded fluid channel (856) as illustrated with dashed lines in FIG. 8. Within the molded panel (843) are the fluid supply slots that deliver fluid to and from the fluidic ejection dies (208). While FIG. 8 depicts four fluid channels (856) feeding four rows (854) of staggered fluid ejection dies (208) is for example, when printing four different colors such as cyan, magenta, yellow, and black, other suitable configurations are possible.

Figure 9:
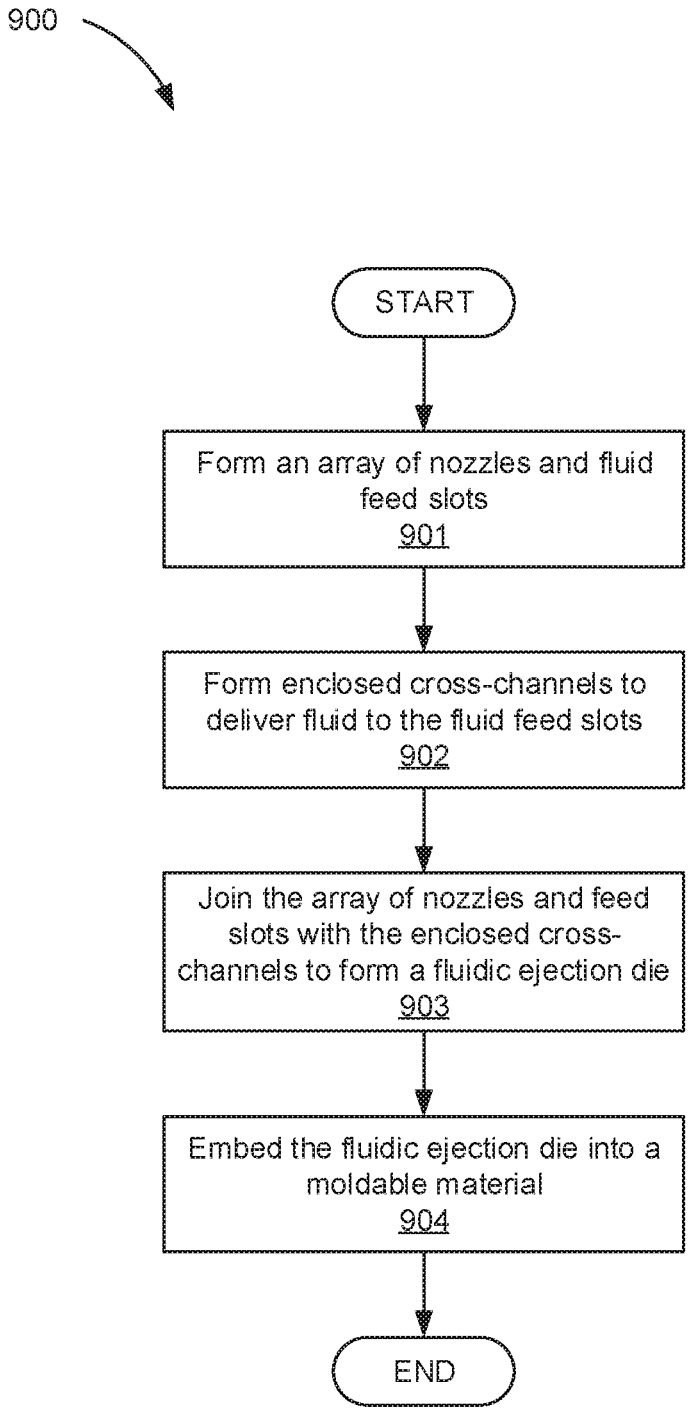
FIG. 9 is a flowchart of a method for forming a fluidic ejection die with enclosed cross-channels, according to an example of the principles described herein.

FIG. 9 is a flowchart of a method (900) for forming a fluidic ejection device (FIG. 1, 100) with enclosed cross-channels (FIG. 2A, 212), according to an example of the principles described herein. According to the method (900), an array of nozzles (FIG. 2A, 210) and passages (FIG. 2B, 222) are formed (block 901). In some examples, the passages (FIG. 2B, 222) may be part of a perforated silicon membrane. The nozzles (FIG. 2A, 210), or rather the openings (FIG. 2B, 216) and the ejection chambers (FIG. 2B, 214) of the nozzles (FIG. 2A, 210), may be formed of a nozzle substrate (FIG. 1, 104) such as SU-8. Accordingly, forming (block 901) the array of nozzles (FIG. 2A, 210) and passages (FIG. 2B, 222) may include joining the perforated silicon membrane with the SU-8 nozzle substrate (FIG. 1, 104).

Enclosed cross-channels (FIG. 2B, 212) are then formed (block 902). Forming (block 902) the enclosed cross-channels (FIG. 2B, 212) may include adhering ribs (FIG. 5, 530) to the backside of the membrane in which the passages (FIG. 2B, 222) are formed and attaching a lid substrate (FIG. 2B, 224). In another example the formation (block 902) may include etching away the channel substrate (FIG. 2B, 220) to form the ribs (FIG. 5, 530) which define in part the enclosed cross-channels (FIG. 2B, 212).

With the enclosed cross-channels (FIG. 2B, 212) formed and the nozzles (FIG. 2A, 210) and passages (FIG. 2B, 222) formed, the two are joined (block 903) to form the fluidic ejection die (FIG. 2A, 208) with enclosed cross-channels (FIG. 2B, 212). With the fluidic ejection die (FIG. 2A, 208) formed, the fluidic ejection die (FIG. 2A, 208) is embedded (block 904) into a moldable material (FIG. 1, 102), which moldable material (FIG. 1, 102) includes supply slots that align with, and provide fluid to the passages (FIG. 2B, 222) and corresponding enclosed cross-channels (FIG. 2A, 212). FIGS. 10A-10D a method of manufacturing a fluidic ejection device (FIG. 1, 100) with enclosed cross-channels (FIG. 2B, 212), according to an example of the principles described herein.

Figure 10A:
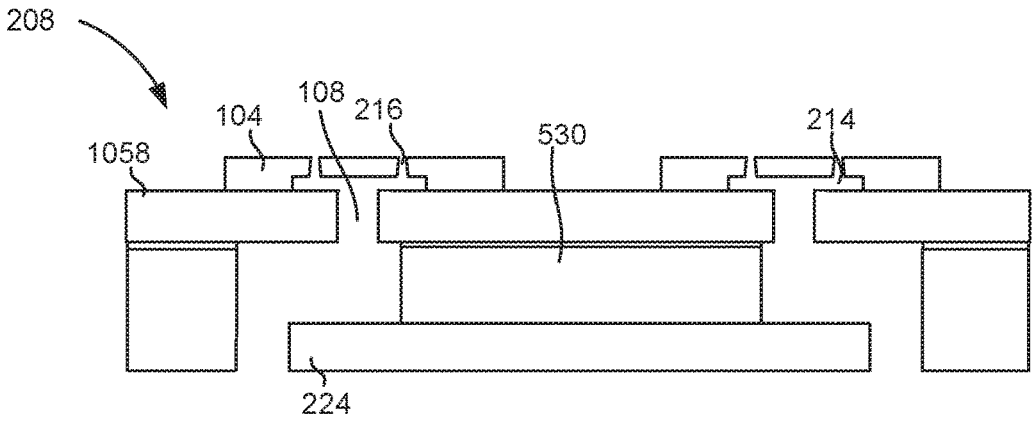
FIGS. 10A through 10D depict a method of manufacturing a fluidic ejection die with enclosed cross-channels, according to an example of the principles described herein.

A fluidic ejection die (208) is formed as depicted in FIG. 10A, The fluidic ejection die (208) may be formed in any number of ways. In general, the nozzle openings (216) and ejection chambers (214) are formed in the nozzle substrate (104) which may be formed of a material such as SU-8. The formation of the openings (216) and ejection chambers (214) in the nozzle substrate (104) may be via etching or photolithography. This nozzle substrate (104) with openings (216) and ejection chambers (214) formed therein is then joined to a layer (1058) that has passages (222) formed therein and that defines the inlets, outlets, and ribs (530) of the fluidic ejection die (208).

Figure 10B:
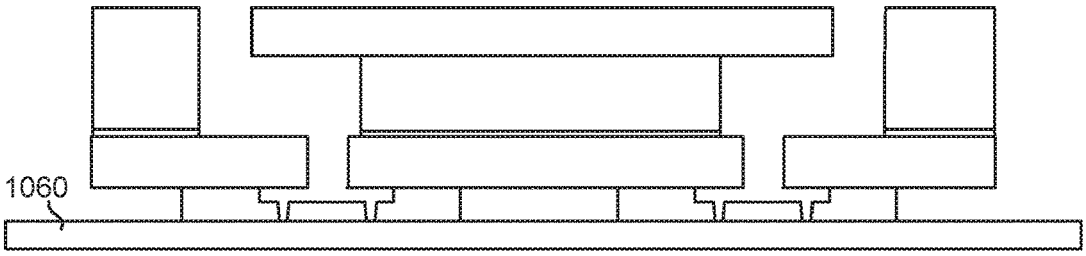
Figure 10C:
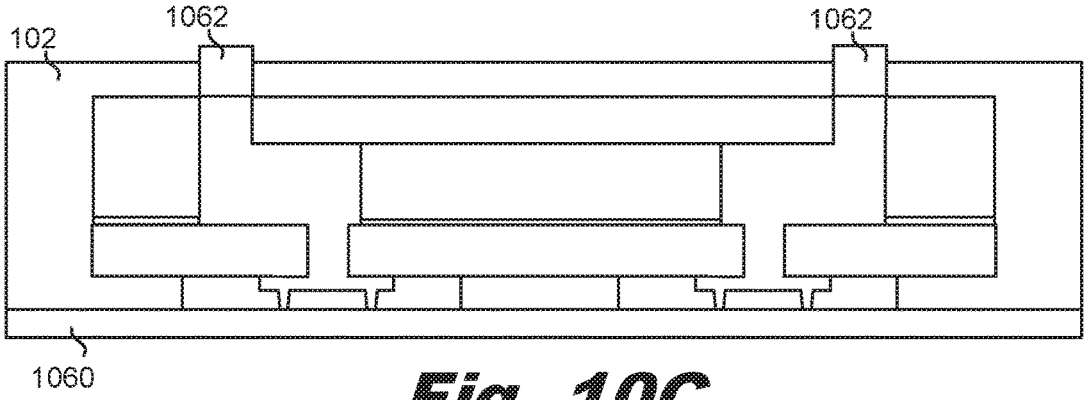

As depicted in FIG. 10B, the fluidic ejection die (208) is inverted and placed on a carrier board (1060), which may be formed of any material such as copper. That is, the nozzle substrate (104) is face down on the carrier board (1060). The fluidic ejection die (208) may be temporarily adhered to the carrier board (1060) via a tape or other adhesive surface.

Next, as depicted in FIG. 100, the moldable material (102) in a molten version is disposed around the fluidic ejection die (208). Inserts (1062) may be placed around the passages (222) such that the moldable material (102) does not flow into, and block, the enclosed cross-channel (FIG. 2B, 212), passages (FIG. 2B, 222), or components of the nozzle (FIG. 2A, 210). These inserts (1062) also define the supply slots in the moldable material (102) as depicted in FIG. 10D.

Figure 10D:
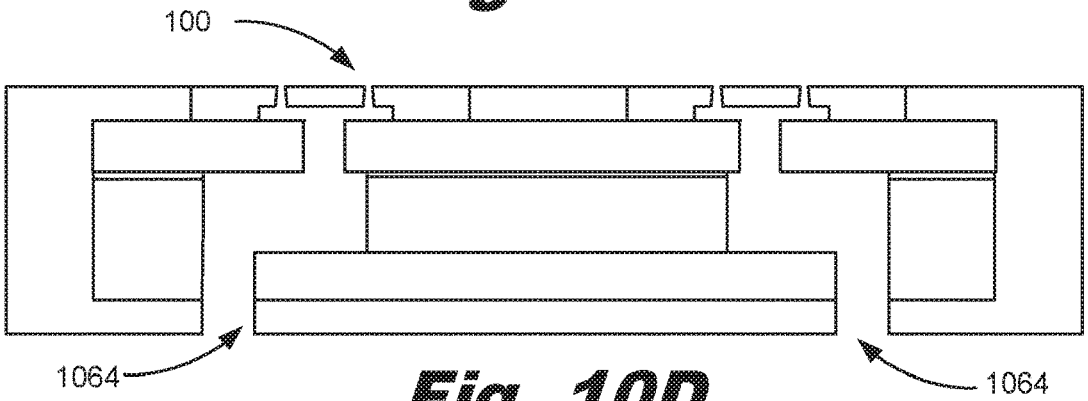

In FIG. 10D, the structure is turned right side up, the carrier board (1060) and inserts (1062) removed, and the structure adhered to a carrier substrate (FIG. 1, 106) such that a fluidic ejection device (100) with enclosed cross-channels (212) remains.

In summary, using such a fluidic ejection die 1) reduces the likelihood of decap by maintaining water concentration in the fluid, 2) facilitates more efficient micro-recirculation within the nozzles, 3) improves nozzle health, 4) provides fluid mixing near the die to increase print quality, 5) convectively cools the fluidic ejection die, 6) removes air bubbles from the fluidic ejection die, and 7) allows for re-priming of the nozzle. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic ejection device, comprising:
a fluidic ejection die embedded in a moldable material, the fluidic ejection die comprising:
an array of nozzles, each nozzle comprising:
an ejection chamber;
an opening; and
a fluid actuator disposed within the ejection chamber;
an array of passages, formed in a substrate, to deliver fluid to and from the ejection chamber; and
an array of enclosed cross-channels, formed within a back surface of the substrate, each enclosed cross-channel of the array being fluidly connected to a respective plurality of passages of the array of passages, wherein fluid flow through the enclosed cross-channels is perpendicular to fluid ejection out of the nozzles;
the moldable material in which the fluidic ejection die is disposed, wherein the moldable material comprises supply slots to deliver fluid to and from the fluidic ejection die; and
a carrier substrate to support the fluidic ejection die and moldable material.

2. The fluidic ejection device of claim 1, wherein the moldable material further comprises an insert to define an inlet supply slot and an outlet supply slot of the moldable material.

3. The fluidic ejection device of claim 1, wherein the moldable material is an epoxy mold compound.

4. The fluidic ejection device of claim 1, wherein fluid flow through the enclosed cross-channel is perpendicular to fluid flow in the passages.

5. The fluidic ejection device of claim 1, wherein:
each nozzle further comprises a channel to direct fluid to and from the corresponding ejection chamber; and
the channel and the passages that correspond to a nozzle form a micro-recirculation loop.

6. The fluidic ejection device of claim 1, wherein the passages are formed in a perforated layer of the substrate.

7. The fluidic ejection device of claim 1, wherein a pair of passages are paired with a corresponding ejection chamber.

8. The fluidic ejection device of claim 1, wherein the supply slots in the moldable material provide fluid to multiple enclosed cross-channels.

9. The fluidic ejection device of claim 1, wherein the fluidic ejection die is a sliver die having a length at least 3 times greater than a width of the fluidic ejection die.

10. The fluidic ejection device of claim 1, wherein:
the array of nozzles is formed in a nozzle substrate; and
the passages and enclosed cross-channels are formed in a channel substrate.

11. The fluidic ejection device of claim 1, wherein the supply slots have tapered sidewalls.

12. The fluidic ejection device of claim 1, wherein:
the array of nozzles is arranged in straight rows; and
the array of enclosed cross-channels is arranged in angled rows.

13. A fluidic ejection device, comprising:
a molded panel formed of a moldable material;
a supply slot in the molded panel to deliver fluid to and from fluidic ejection die;
a plurality of fluidic ejection dies embedded in the molded panel, each ejection die comprising:
an array of nozzles, each nozzle comprising:
an ejection chamber;
an opening; and
a fluid actuator disposed within the ejection chamber;
an array of passages, formed in a substrate, to deliver fluid to and from the ejection chamber; and
an array of enclosed cross-channels, formed within a back surface of the substrate, each enclosed cross-channel of the array of enclosed cross channels being fluidly connected to a respective plurality of passages of the array of passages, wherein fluid flow through the enclosed cross-channels is perpendicular to fluid ejection out the nozzles;
an inlet passage from the supply slot to the enclosed cross-channel;
an outlet passage from the enclosed cross-channel to the supply slot; and
a carrier substrate to support the fluidic ejection die and molded panel.

14. The fluidic ejection device of claim 13, wherein:
each nozzle further comprises:
a channel to direct fluid to and from the corresponding ejection chamber;
a secondary fluid actuator to move fluid through the channel; and
the channel and passages that correspond to a nozzle form a micro-recirculation loop of the nozzle.

15. The fluidic ejection device of claim 13, wherein:
the printhead is a substrate-wide printbar; and
the fluidic ejection dies are staggered across a width of a substrate on which the fluid is to be deposited.

16. The fluidic ejection device of claim 13, wherein:
the printhead is a multi-color printhead;
different subsets of the array of nozzles correspond to different colors;
different subsets of enclosed cross-channels deliver fluid to rows of the different subsets of the array of nozzles.

17. The fluidic ejection device of claim 13, wherein the inlet passage and the outlet passage are shared by multiple enclosed cross-channels.

18. A method for making a fluidic ejection device comprising:
forming an array of nozzles through which fluid is ejected;
forming, in a substrate, an array of passages to deliver fluid to and from the array of nozzles;
forming a number of enclosed cross-channels within a back surface of the substrate, wherein the number of enclosed cross-channels:
deliver fluid to and from the passages; and
have a fluid flow therethrough that is perpendicular to fluid ejection out the array of nozzles;

joining the array of nozzles and corresponding passages to the number of enclosed cross-channels to form a fluidic ejection die; and embedding the fluidic ejection die into a moldable material, wherein the moldable material comprises supply slots that provide fluid to the number of enclosed cross-channels.

19. The method of claim 18, wherein forming the number of enclosed cross-channels on the substrate comprises etching the back layer of the substrate.

20. The method of claim 18, wherein forming the array of nozzles and corresponding passages comprises adhering a membrane containing the passages to a layer that defines the nozzles.

* * * * *